US010196589B2

(12) United States Patent
Everaert et al.

(10) Patent No.: US 10,196,589 B2
(45) Date of Patent: Feb. 5, 2019

(54) HOME CARE COMPOSITION COMPRISING A MIXED HYDROPHOBICALLY MODIFIED CATIONIC POLYSACCHARIDE

(71) Applicant: HERCULES LLC, Wilmington, DE (US)

(72) Inventors: Emmanuel Paul Jos Marie Everaert, Galder (NL); Gijsbert Kroon, Giessenburg (NL); Adrianus Theodorus Pickert, Rijswijk (NL)

(73) Assignee: HERCULES LLC, Wilmington, DE (US)

( * ) Notice: Subject to any disclaimer, the term of this patent is extended or adjusted under 35 U.S.C. 154(b) by 62 days.

(21) Appl. No.: 15/432,386

(22) Filed: Feb. 14, 2017

(65) Prior Publication Data

US 2017/0233683 A1 Aug. 17, 2017

Related U.S. Application Data

(60) Provisional application No. 62/295,190, filed on Feb. 15, 2016.

(51) Int. Cl.

| | |
|---|---|
| ***C11D 3/22*** | (2006.01) |
| ***C11D 1/22*** | (2006.01) |
| ***C11D 1/29*** | (2006.01) |
| ***C11D 1/66*** | (2006.01) |
| ***C11D 3/20*** | (2006.01) |
| ***C11D 3/37*** | (2006.01) |
| ***C11D 3/28*** | (2006.01) |

(52) U.S. Cl.

CPC ..... *C11D 3/225* (2013.01); *C11D 1/22* (2013.01); *C11D 1/29* (2013.01); *C11D 1/66* (2013.01); *C11D 3/2041* (2013.01); *C11D 3/28* (2013.01); *C11D 3/3723* (2013.01)

(58) Field of Classification Search

CPC .. C11D 3/225; C11D 1/22; C11D 1/29; C11D 1/66

See application file for complete search history.

(56) References Cited

U.S. PATENT DOCUMENTS

| | | | | |
|---|---|---|---|---|
| 5,773,405 | A * | 6/1998 | Bruhnke | C09B 69/00 510/180 |
| 8,512,480 | B2 * | 8/2013 | Gomez Ruiz | C08B 11/02 134/25.2 |
| 2011/0177018 | A1 * | 7/2011 | Lipic | A61K 8/046 424/70.13 |

* cited by examiner

*Primary Examiner* — Charles I Boyer
(74) *Attorney, Agent, or Firm* — Shaorong Chen

(57) ABSTRACT

The presently disclosed and/or claimed inventive concept(s) relates to a liquid home care composition comprising a mixed hydrophobically modified cationic polysaccharide comprising a polysaccharide backbone having at least one cationic group, at least one $C_3$-$C_8$ short chain hydrophobic group and at least one $C_9$-$C_{24}$ long chain hydrophobic group attached thereon; at least one surfactants, and at least one additive agent used on the liquid home care composition. The liquid home care composition is a single clear, transparent liquid.

19 Claims, No Drawings

HOME CARE COMPOSITION COMPRISING A MIXED HYDROPHOBICALLY MODIFIED CATIONIC POLYSACCHARIDE

CROSS REFERENCE TO RELATED APPLICATIONS

The present application claims the benefit under 35 U.S.C. 119 (e) of U.S. Provisional Patent Application Ser. No. 62/295,190, filed on Feb. 15, 2016, the entire content of which is hereby expressly incorporated herein by reference.

BACKGROUND OF THE INVENTION

1. Field of the Disclosed and Claimed Inventive Concept(s)

The presently disclosed and/or claimed inventive process(es), procedure(s), method(s), product(s), result(s), and/or concept(s) (collectively referred to hereinafter as the "present disclosure") relates generally to a liquid home care composition and use thereof. More particularly, but not by way of limitation, the present disclosure relates to a liquid home care composition comprising a mixed hydrophobically modified cationic polysaccharide comprising a polysaccharide backbone having at least one cationic group, and at least one $C_3$-$C_8$ short chain hydrophobic group and at least one $C_9$-$C_{24}$ long chain hydrophobic group attached thereon.

2. Background and Applicable Aspects of the Disclosed and Claimed Inventive Concept(s)

Liquid home care products are often considered to be more convenient to use than dry powdered or particulate home care products. Liquid home care products have therefore found substantial favor with consumers. Such liquid home care products are readily measurable, speedily dissolved in wash water, capable of being easily applied in concentrated solutions or dispersions to soiled areas to be cleaned and are non-dusting. Additionally, liquid home care products may have incorporated in their formulations materials which could not withstand drying operations without deterioration, which operations are often employed in the manufacture of particulate or granular home care products.

Liquid home care products in terms of their most basic components generally comprise functional ingredients such as one or more surface active agents (surfactants) that promote and facilitate the removal of stains and soils in aqueous wash solutions formed from such liquid home care products. Liquid home care products will also generally contain a liquid carrier such as water which serves to dissolve or at least suspend the essential functional surfactant ingredients.

In addition to the surfactants and liquid carrier, heavy duty liquid home care products can also contain a wide variety of additional functional ingredients which serve to boost the cleaning effectiveness of the products into which they are incorporated. Such additional functional ingredients can include, for example, but not by way of limitation, various organic and inorganic builders, chelating agents, bleaching agents, bleach activators or catalysts, enzymes, enzyme stabilizers, grease/oil solvents, dye transfer inhibition agents, pH controllers, brighteners and the like. While such additional components can enhance the products cleaning performance, such additional functional materials can also be relatively expensive, thereby driving up the cost of manufacture of such products and ultimately driving up the cost of such products to the consumer.

The ideal liquid home care product must be dispensible from the means currently used for dispensing powders. This requires that such a liquid have a fairly high viscosity so that it will not run out of a loosely sealed dispensing cup meant for powders. In order to achieve viscosities as high as are desired in a system such as this, it is useful to use thickeners. However, the thickeners are generally used in such high amounts as to render the liquid home care product hazy. In addition, the thickeners are not compatible with more complex liquid home care formulations. The opaque liquid home care product prevents the decomposition of light-sensitive components but also has the disadvantage that the consumer cannot see the appearance and amount of the liquid home care product. A need therefore exists for developing a clear, or translucent, or transparent liquid home care product with high shear viscosity, in which the viscosity will be reduced when shear stress is increased and will be compatible and effective with the complex liquid home care formulations.

DETAILED DESCRIPTION

Before explaining at least one embodiment of the present disclosure in detail, it is to be understood that the present disclosure is not limited in its application to the details of construction and the arrangement of the components or steps or methodologies set forth in the following description or illustrated in the drawings. The present disclosure is capable of other embodiments or of being practiced or carried out in various ways. Also, it is to be understood that the phraseology and terminology employed herein is for the purpose of description and should not be regarded as limiting.

Unless otherwise defined herein, technical terms used in connection with the present disclosure shall have the meanings that are commonly understood by those of ordinary skill in the art. Further, unless otherwise required by context, singular terms shall include pluralities and plural terms shall include the singular.

All patents, published patent applications, and non-patent publications mentioned in the specification are indicative of the level of skill of those skilled in the art to which the present disclosure pertains. All patents, published patent applications, and non-patent publications referenced in any portion of this application are herein expressly incorporated by reference in their entirety to the same extent as if each individual patent or publication was specifically and individually indicated to be incorporated by reference.

All of the articles and/or methods disclosed herein can be made and executed without undue experimentation in light of the present disclosure. While the articles and methods of the present disclosure have been described in terms of preferred embodiments, it will be apparent to those of ordinary skill in the art that variations may be applied to the articles and/or methods and in the steps or in the sequence of steps of the method described herein without departing from the concept, spirit and scope of the present disclosure. All such similar substitutes and modifications apparent to those skilled in the art are deemed to be within the spirit, scope and concept of the present disclosure.

As utilized in accordance with the present disclosure, the following terms, unless otherwise indicated, shall be understood to have the following meanings.

The use of the word "a" or "an" when used in conjunction with the term "comprising" may mean "one," but it is also consistent with the meaning of "one or more," "at least one," and "one or more than one." The use of the term "or" is used to mean "and/or" unless explicitly indicated to refer to alternatives only if the alternatives are mutually exclusive, although the present disclosure supports a definition that refers to only alternatives and "and/or." Throughout this application, the term "about" is used to indicate that a value includes the inherent variation of error for the quantifying device, the method being employed to determine the value, or the variation that exists among the study subjects. For example, but not by way of limitation, when the term "about" is utilized, the designated value may vary by plus or minus twelve percent, or eleven percent, or ten percent, or nine percent, or eight percent, or seven percent, or six percent, or five percent, or four percent, or three percent, or two percent, or one percent. The use of the term "at least one" will be understood to include one as well as any quantity more than one, including but not limited to, 1, 2, 3, 4, 5, 10, 15, 20, 30, 40, 50, 100, etc. The term "at least one" may extend up to 100 or 1000 or more depending on the term to which it is attached. In addition, the quantities of 100/1000 are not to be considered limiting as lower or higher limits may also produce satisfactory results. In addition, the use of the term "at least one of X, Y, and Z" will be understood to include X alone, Y alone, and Z alone, as well as any combination of X, Y, and Z. The use of ordinal number terminology (i.e., "first", "second", "third", "fourth", etc.) is solely for the purpose of differentiating between two or more items and, unless otherwise stated, is not meant to imply any sequence or order or importance to one item over another or any order of addition.

As used herein, the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps. The term "or combinations thereof" as used herein refers to all permutations and combinations of the listed items preceding the term. For example, "A, B, C, or combinations thereof" is intended to include at least one of: A, B, C, AB, AC, BC, or ABC and, if order is important in a particular context, also BA, CA, CB, CBA, BCA, ACB, BAC, or CAB. Continuing with this example, expressly included are combinations that contain repeats of one or more items or terms, such as BB, AAA, MB, BBC, AAABCCCC, CBBAAA, CABABB, and so forth. The skilled artisan will understand that typically there is no limit on the number of items or terms in any combination, unless otherwise apparent from the context.

As used herein, the term "substantially" means that the subsequently described event or circumstance completely occurs or that the subsequently described event or circumstance occurs to a great extent or degree. For example, when associated with a particular event or circumstance, the term "substantially" means that the subsequently described event or circumstance occurs at least 80% of the time, or at least 85% of the time, or at least 90% of the time, or at least 95% of the time.

Turning now to the present disclosure, certain embodiments thereof are directed to a liquid home care composition comprising: (a) a mixed hydrophobically modified cationic polysaccharide comprising a polysaccharide backbone having at least one cationic group, and at least one $C_3$-$C_8$ short chain hydrophobic group and at least one $C_9$-$C_{24}$ long chain hydrophobic group attached thereon; (b) at least one surfactant; and (c) at least one additive agent selected from the group consisting of detergent adjuvants or builders, auxiliary cleaning agents, acidic cleaning agents, metal chelating agents, calcium sequestering agents, hydrotropic agents, bleaching agents, abrasives, biocidal or antimicrobial agents, corrosion inhibitors, enzymes, anti-redeposition agents, anti-color transfer agents, and soil-release agents. The liquid home care composition is a clear single phase liquid. The mixed hydrophobically modified cationic polysaccharide can be soluble in water, or insoluble in water but soluble in solutions containing at least one surfactant.

In one non-limiting embodiment, the mixed hydrophobically modified cationic polysaccharide can be produced by substituting the polysaccharide backbone with the at least one cationic group and then with the hydrophobic groups containing at least one $C_3$-$C_8$ short chain and at least one $C_9$-$C_{24}$ long chain. In another non-limiting embodiment, the mixed hydrophobically modified cationic polysaccharide can be produced by substituting the polysaccharide backbone with the hydrophobic groups containing at least one $C_3$-$C_8$ short chain and at least one $C_9$-$C_{24}$ long chain and then with the at least one cationic group.

Polysaccharides substituted with at least one cationic group for use in the present disclosure can include any naturally occurring cationic polysaccharides as well as polysaccharide derivatives that have been cationized by chemical reactions.

Cationic substitution of the polysaccharide or hydrophobically modified polysaccharide can typically be accomplished through the reaction of the polysaccharide hydroxyl groups with cationic epoxide reagents, where the cationic group is a quaternary ammonium group; or the reaction of the hydroxyl groups with cationic reagents containing other reactive functionality, such as chlorohydrin functionality, or isocyanate functionality.

In one non-limiting embodiment, the polysaccharide or hydrophobically modified. polysaccharide can be modified with quaternary nitrogen-containing substituents through quaternization reactions that may be achieved by reacting the polysaccharide or the hydrophobically modified polysaccharide with quaternizing agents which are quaternary ammonium salts, including mixtures thereof, to effect substitution of the polysaccharide with quaternary nitrogen containing groups on the backbone. Typical quaternary ammonium salts that can be used include quaternary nitrogen containing halides, halohydrins, and epoxides. Examples of the quaternary ammonium salts can include one or more of the following: 3-chloro-2-hydroxypropyl dimethyldodecyl ammonium chloride; 3-chloro-2-hydroxypropyl dimethylocetadecyl ammonium chloride; 3-chloro-2-hydroxypropyl dimethyloctyl ammonium chloride; 3-chloro-2-hydroxypropyl trimethyl ammonium chloride; 2-chloroethyl trimethyl ammonium chloride; 2, 3-epoxypropyl trimethyl ammonium chloride; and the like. Preferred quaternization agents include 3-chloro-2-hydroxyupropyl trimethyl ammonium chloride; 3-chloro-2-hydroxypropyl dimethyloctadecyl ammonium chloride; 3-chloro-2-hydroxypropyl dirnethyltetradecyl ammonium chloride; 3-chloro-2-hydroxypropyl dimethylhexadecyl ammonium chloride; 3-chloro-2-hydroxypropyl dimethyldodecyl ammonium chloride; and 3-chloro-2-hydroxypropyl dimethyloctadecyl ammonium chloride.

Quaternization reactions can also be achieved using a two-step synthesis of (1) aminating the polysaccharide or hydrophobically modified polysaccharide by reacting with an aminating agent, such as an amine halide, halohydrin or epoxide, followed by (2) quaternizing the product of the step (1) by reacting with an quaternizing agent, or mixtures thereof, containing a functioning group which forms a salt with the amine.

In accordance with the present disclosure, the polysaccharide backbone of the mixed hydrophobically modified cationic polysaccharide can be cellulose ether. Examples of the cellulose ethers can be, but are not limited to, hydroxyethylcellulose (HEC), hydroxypropylcellulose (HPC), methylcellulose (MC), hydroxypropylmethylcellulose (HPMC), ethylhydroxyethylcellulose (EHEC), and methylhydroxyethylcellulose (MHEC).

More specifically, the cellulose ether has a hydroxyethyl molar substitution (HEMS) from 2 to 5. In one non-limiting the cellulose ether has a hydroxyethyl molar substitution (HEMS) from 3 to 5. In another non-limiting the cellulose ether has a hydroxyethyl molar substitution (HEMS) from 3.5 to 5.0.

In accordance with the present disclosure, the short chain hydrophobic group contains 3 to 8 carbon atoms. In one non-limiting embodiment, the short chain hydrophobic group contains from 3 to 5 carbon atoms. Examples of such moieties can be, but are not limited to, propyl, butyl, and pentyl radicals. In another non-limiting embodiment, the short chain hydrophobic group contains 4 carbon atoms. The long chain hydrophobic group contains 9 to 24 carbon atoms. Examples of such moieties can include, but are not limited to, nonyl, hexadecyl, and decyl dodecyl. In one non-limiting embodiment, the long chain hydrophobic group contains 16 carbon atoms.

The mixed hydrophobically modified cationic polysaccharides of the present disclosure can be prepared in a slurry of the desired polysaccharide in an inert aqueous diluent system. Suitable diluents include, but are not limited to, isopropyl alcohol, t-butyl alcohol, sec-butyl alcohol, propyl alcohol, ethanol, methanol, methylethylketone, water, tetrahydrofuran, dioxane, 2-butoxyethanol, 2-ethoxyethanol, acetone, and mixtures of these materials. Suitable weight ratios of diluent to polysaccharide are in the range of 4:1 to 25:1. The polysaccharide may be causticized with a suitable caustic catalyst such as sodium hydroxide, potassium hydroxide or lithium hydroxide, with sodium hydroxide being preferred. The molar ratio of caustic to polysaccharide may suitably vary between 0.4 and 2.0. Many polysaccharides that are in contact with any base may be readily degraded by oxygen. It is accordingly necessary to exclude oxygen from the reaction vessel during the time in which caustic is present. It is suitable to carry out the reaction under an inert gas such as nitrogen. Later, substituents such as etherification agents, hydrophobic agents and cationic agents can be added into the slurry.

In one non-limiting embodiment, the polysaccharide can be made from a cellulose source, such as cotton and/or wood pulp, which reacts with a mixture of t-butyl alcohol, isopropyl alcohol, acetone, water and sodium hydroxide under a nitrogen atmosphere for a period of time that is sufficient to distribute the alkali onto the cellulose. Then, ethylene oxide is added to the alkali cellulose slurry, followed by heating at about 70° C. for about one hour. The resulting slurry is partially neutralized and additional ethylene oxide is added to the reaction mixture. The resulting reaction mixture is heated at about 90-95° C. for about 90 minutes. Caustic and alkyl bromides (two different alkyl bromides, one having 3-8 carbon atoms and the other having 9-24 carbon atoms) can be added, followed by heating of the reaction mixture at about 124° C. for about 2 hours and then cooled down. Cationic agent such as hydroxypropyltrimethylammonium chloride can be added and the temperature can be raised to about 60° C. The reaction mixture is then cooled and neutralized.

Another method for preparing the mixed hydrophobically modified polysaccharide polymer of the present disclosure is to start from a commercial intermediate product. Briefly, the modifications can be effected by slurrying a polymer, such as hydroxyethylcellulose, in an inert organic diluent such as a lower aliphatic alcohol, ketone, or hydrocarbon and adding a solution of alkali metal hydroxide to the resultant slurry at a low temperature. When the cellulose ether is thoroughly wetted and swollen by the alkali, a mixture of alkylglycidyl ethers is added and the reaction is continued with agitation and heating until completed. Later a cationic agent is added. Residual alkali is then neutralized and the product is recovered, washed with inert diluents, and dried.

In accordance with the present disclosure, the mixed hydrophobically modified cationic polysaccharides have a weight average molecular weight (Mw) ranged from about 50,000 to 1,500,000 Daltons. In one non-limiting embodiment, the mixed hydrophobically modified cationic polysaccharides have a weight average molecular weight (Mw) ranged from about 100,000 to 1,000,000 Daltons. In another non-limiting embodiment, the mixed hydrophobically modified cationic polysaccharides have a weight average molecular weight (Mw) ranged from about 300,000 to 700,000 Daltons.

The weight average molecular weight of the mixed hydrophobically modified cationic polysaccharides can be measured by standard analytical measurements, such as size exclusion chromatography (SEC).

The amounts of cationic groups on the mixed hydrophobically modified cationic polysaccharide can be expressed in terms of "cationic degree of substitution (DS)", which is a molar substitution and equivalent to the average number of moles of cationic groups per anhydro sugar unit in the polysaccharide backbone. The cationic group can be present on the mixed hydrophobically modified polysaccharide at a DS level of 0.001 to 2.0. In one non-limiting embodiment, the DS level is from 0.01 to 1.0. In another non-limiting embodiment, the DS level is from 0.01 to 0.5. In yet another non-limiting embodiment, the DS level is from 0.01 to 0.3. In yet another non-limiting embodiment, the DS level is from 0.05 to 0.2. In yet another non-limiting embodiment, the DS level is from 0.06 to 0.15.

In addition to molar substitution, the cationic charge on the mixed hydrophobically modified cationic polysaccharide of this present disclosure can be quantified as a charge density. The molar substitution can be converted to a charge density through a variety of methods. The preferred method for calculating charge density of cationic polymers uses a method that specifically quantifies the equivalents of quaternary ammonium groups on the polymer.

Charge density can also be measured by any method that quantifies the net positive or negative charge present on a polymer. The charge density can be determined by measurement of the moles of quaternary ammonium groups bound to the polymer backbone using standard NMR techniques of integration.

The short chain hydrophobic group content is at least 0.5 wt % of the mixed hydrophobically modified cationic polysaccharide. In one non-limiting embodiment, the short chain group content is in a range of from about 1.0 to about 7.0 wt % of the mixed hydrophobically modified cationic polysaccharide. In another non-limiting embodiment, the short chain group content is in a range of from about 2.5 to about 7.0 wt % of the mixed hydrophobically modified cationic polysaccharide. In yet another non-limiting embodiment, the short chain group content is in a range of from about 3.5 to about 5.0 wt % of the mixed hydrophobically modified cationic polysaccharide.

The long chain hydrophobic group content is at least 0.1 wt % of the mixed hydrophobically modified cationic polysaccharide. In one non-limiting embodiment, the long chain group content is in a range of from about 0.1 to about 2.5 wt % of the mixed hydrophobically cationic modified polysaccharide. In another non-limiting embodiment, the long chain group content is in a range of from about 0.5 to about 2.5 wt % of the mixed hydrophobically modified cationic polysaccharide. In yet another non-limiting embodiment, the long chain group content is in a range of from about 1.0 to about 2.0 wt % of the mixed hydrophobically modified cationic polysaccharide.

Depending upon the target application viscosity, the mixed hydrophobically modified cationic polysaccharide can generally be used in an amount of from about 0.01% to about 2.0% by weight or from about 0.1 to about 1% by weight or from about 0.2 to about 0.6% by weight of the liquid home care composition.

The at least one surfactant can be selected from the group consisting of a nonionic surfactant, an anionic surfactant, an amphoteric surfactant, a zwitterionic surfactant, and combinations thereof. The anionic surfactants which are suitable for use herein can include water-soluble salts. The water-soluble salts can be alkali metal and ammonium salts of organic sulfuric reaction products having an alkyl group containing from about 10 to about 20 carbon atoms and a sulfonic acid or sulfuric acid ester group. (Included in the term "alkyl" is the alkyl portion of acyl groups.).

Examples of this group of synthetic surfactants can include, but are not limited to, a) the sodium, potassium and ammonium alkyl sulfates, especially those obtained by sulfating the higher alcohols ($C_8$-$C_{18}$ carbon atoms) such as those produced by reducing the glycerides of tallow or coconut oil; b) the sodium, potassium and ammonium alkyl polyethoxylate sulfates, particularly those in which the alkyl group contains from about 10 to about 22 carbon atoms, or from about 12 to about 18 carbon atoms, and wherein the polyethoxylate chain contains from 1 to about 15, or from 1 to about 6 ethoxylate moieties; and c) the sodium and potassium alkylbenzene sulfonates in which the alkyl group contains from about 9 to about 15 carbon atoms, in straight chain or branched chain configuration, e.g., those of the type described in U.S. Pat. Nos. 2,220,099 and 2,477,383, which are incorporated herein by reference in their entirety.

The sulfate or sulfonate surfactants may be selected from $C_{11-18}$ alkyl benzene sulfonates (LAS); $C_8$-$C_{20}$ primary, branched-chain and random alkyl sulfates (AS); $C_{10}$-$C_{18}$ secondary (2,3) alkyl sulfates; $C_{10}$-$C_{18}$ alkyl alkoxy sulfates ($AE_xS$) wherein x is from 1-30; $C_{10}$-$C_{18}$ alkyl alkoxy carboxylates comprising 1-5 ethoxy units; mid-chain branched alkyl sulfates as disclosed in U.S. Pat. Nos. 6,020,303 and 6,060,443; mid-chain branched alkyl alkoxy sulfates as disclosed in U.S. Pat. Nos. 6,008,181 and 6,020,303; modified alkylbenzene sulfonate (MLAS) as disclosed in WO 99/05243, WO 99/05242, WO 99/05244, WO 99/05082, WO 99/05084, WO 99/05241, WO 99/07656, WO 00/23549, and WO 00/23548; methyl ester sulfonate (MES); and alpha-olefin sulfonate (AOS). All the above described patents and patent publications are hereby enclosed by reference in their entirety.

The paraffin sulfonates may be rnonosulfonates or disulfonates and usually are mixtures thereof, obtained by sulfonating paraffins of about 10 to about 20 carbon atoms. In one non-limiting embodiment, the sulfonates are those of C12-18 carbon atoms chains. In another non-limiting embodiment, the sulphonates are C14-17 carbon atoms chains. Paraffin sulfonates that have the sulfonate group(s) distributed along the paraffin chain are described in U.S. Pat. Nos. 2,503,280; 2,507,088; 3,260,744; 3,372,188 and in DE 735 096, which are hereby enclosed by reference in their entirety.

Alkyl glyceryl sulfonate surfactants and/or alkyl glyceryl sulfate surfactants generally used have high monomer content (greater than about 60 wt % by weight of the alkyl glycerol sulfonate surfactant). As used herein "oligomer" includes dimer, trimer, tetramer, and oligomers up to heptamers of alkyl glyceryl sulfonate surfactant and/or alkyl glyceryl sulfate surfactant. Minimization of the monomer content may be from 0 wt % to about 60 wt %, or from 0 wt % to about 55 wt %, from 0 wt % to about 50 wt %, from 0 wt % to about 30 wt %, by weight of the alkyl glyceryl sulfonate surfactant and/or alkyl glyceryl sulfate surfactant present.

The alkyl glyceryl sulfonate surfactant and/or alkyl glyceryl sulfate surfactant for use herein can include such surfactants having an alkyl chain length of $C_{10-40}$, or $C_{10-22}$, or $C_{12-18}$, or $C_{16-18}$. The alkyl chain may be branched or linear, wherein when present, the branches comprise a $C_{1-4}$ alkyl moiety, such as methyl ($C_1$) or ethyl ($C_2$). These surfactants are described in detail in WO2006/041740, which is enclosed herein by reference in its entirety. The alkyl glyceryl sulfate; sulfonate surfactant is optionally present at a level of at least 10%, or from 10% to about 40%, or from 10% to about 30% by weight of the composition.

The anionic surfactant can be dialkylsulfosuccinates. The dialkyl sulfosuccinates may be a $C_{6-15}$ linear or branched dialkyl sulfosuccinate. The alkyl moieties may be symmetrical (i.e., the same alkyl moieties) or asymmetrical (i.e., different alkyl moieties). In one non-limiting embodiment, the alkyl moiety is symmetrical. The dialkyl sulfosuccinates may be present in the liquid home care composition from about 0.5% to about 10% by weight of the composition.

Suitable nonionic surfactants in the present disclosure can include alkoxylated materials, particularly addition products of ethylene oxide and/or propylene oxide with fatty alcohols, fatty acids and fatty amines.

The alkoxylated materials can have a general formula as follows:

$$R—Y—(CH_2CH_2O)_zH$$

where R is a hydrophobic moiety, typically being an alkyl or alkenyl group, the group being linear or branched, primary or secondary, and having from about 8 to about 25 carbon atoms, or from about 10 to about 20 carbon atoms, or from about 10 to about18 carbon atoms. R may also be an aromatic group, such as a phenolic group, substituted by an alkyl or alkenyl group as described above; Y is a linking group, typically being O, CO.O, or CO.N($R^1$), where $R^1$ is H or a $C_{1-4}$ alkyl group; and z represents the average number of ethoxylate (EO) units present, the number being about 8 or more, or about 10 or more, from about 10 to about 30, or from about 12 to about 25, or from about 12 to about 20.

Examples of suitable nonionic surfactants can include the ethoxylates of mixed natural or synthetic alcohols in the "coca" or "tallow" chain length. In one non-limiting embodiment, the non-ionic surfactants can be condensation products of coconut fatty alcohol with about 15-20 moles of ethylene oxide and condensation products of tallow fatty alcohol with about 10-20 moles of ethylene oxide.

The ethoxylates of secondary alcohols such as 3-hexadecanol, 2-octadecanol, 4-eicosanol, and 5-eicosanol may also be used. Exemplary ethoxylated secondary alcohols can have formulae $C_{12}$-EO(20); $C_{14}$-EO(20); $C_{14}$-EO(25); and $C_{16}$-EO(30). The secondary alcohols can include Tergitol™ 15-S-3(commercially available from The Dow Chemical Company) and those disclosed in PCT/EP2004/003992, which is enclosed herein by reference in its entirety.

Polyol-based nonionic surfactants may also be used, examples including sucrose esters (such as sucrose monooleate), alkyl polyglucosides (such as stearyl monoglucoside and stearyl triglucoside), and alkyl polyglycerols.

The nonionic surfactants used in the present disclosure can be reaction products of long-chain alcohols with several moles of ethylene oxide having a weight average molecular weight of about 300 to about 3000 Daltons. One of the nonionic surfactants is a lower hydrophillic ethoxylate. The lower hydrophillic ethoxylate is linear alcohol ethoxylate where a $C_9$-$C_{11}$ and/or $C_{12}$-$C_{18}$ linear alcohol chain is ethoxylated with an average of 1.0 to 5.0 moles of ethylene oxide per chain, or 2.0 to 4.0 moles of ethylene oxide.

The nonionic surfactant can also be a higher ethoxylate. The higher ethoxylate is a linear alcohol ethoxylate where a $C_9$-$C_{11}$ and/or $C_{12}$-$C_{18}$ linear alcohol chain is ethoxylated with at least 6.0 moles of ethylene oxide per chain, or an average of 6.0 to 20.0 moles of ethylene oxide per chain, or an average of 6.0 moles to 12.0 moles of ethylene oxide per chain. The ratio of lower ethoxylate to higher ethoxylate can be from about 1:10 to about 10:1, or from about 1:4 to 4:1.

In one non-limiting embodiment, the nonionic surfactants can be mixtures of $C_9$-$C_{11}$ linear alcohols ethoxylated with an average of 2.5, 6.0 and 8.0 moles of ethylene oxide per chain. The ratio of the 6 mole ethoxylates to 2.5 moles ethoxylates is preferably in the range of 1.5:1 to 2:1 and for 8 mole ethoxylates is in the range of 2.3:1.

The amphoteric surfactants suitable for use in the present disclosure can include those that are broadly described as derivatives of aliphatic secondary and tertiary amines in which the aliphatic radical can be straight or branched chain and wherein one of the aliphatic substituents contains from about 8 to about 18 carbon atoms and one contains an anionic water solubilizing group, e.g., carboxy, sulfonate, sulfate, phosphate, or phosphonate. Examples of compounds falling within this definition are sodium 3-dodecyl-aminopropionate, sodium 3-dodecylaminopropane sulfonate, sodium lauryl sarcosinate, N-alkyltaurines such as the one prepared by reacting dodecylamine with sodium isethionate according to the teaching of U.S. Pat. No. 2,658,072, N-higher alkyl aspartic acids such as those produced according to the teaching of U.S. Pat. No. 2,438,091, and the products described in U.S. Pat. No. 2,528,378.

The zwitterionic surfactants suitable for use can include those that are broadly described as derivatives of aliphatic quaternary ammonium, phosphonium, and sulfonium compounds, in which the aliphatic radicals can be straight or branched chain, and wherein one of the aliphatic substituents contains from about 8 to about 18 carbon atoms and one contains an anionic group, e.g., carboxy, sulfonate, sulfate, phosphate, or phosphonate. The zwitterionic surfactants which are suitable include betaines, such as cocoamidopropyl betaine.

The amphoteric surfactants suitable herein may also include alkylamphoacetates such as lauroamphoacetate and cocoamphoacetate. The alkylamphoacetates can be comprised of monoacetates and diacetates. In some types of the alkylamphoacetates, diacetates are impurities or unintended reaction products.

The amounts of the at least one surfactant can be varied from about 0.3 wt % to about 80 wt % or from about 0.3 wt % to about 76 wt %. For a liquid home care composition with low contents of surfactants, the amounts of the at least one surfactant can be varied from about 0.3 wt % to about 6 wt %. In one non-limiting embodiment, the amounts of the at least one surfactant can be varied from about 2.5 wt % to about 5 wt %.

For a liquid home care composition with medium contents of surfactants, the amounts of the at least one surfactant can be varied from about 6 wt % to about 22 wt %. In one non-limiting embodiment, the amounts of the at least one surfactant can be varied from about 12 wt % to about 17 wt %.

For a liquid home care composition with high contents of surfactants, the amounts of the at least one surfactant can be varied from about 22 wt % to 76 wt %. In one non-limiting embodiment, the amounts of the at least one surfactant can be varied from about 20 wt % to about 42 wt %.

The liquid home care compositions of the present disclosure are typically aqueous. The aqueous base typically comprises about 80% or greater, or about 90% or greater, or 95% or greater by weight of water. The water in the aqueous base typically comprises about 40% or greater, or 6 wt % or greater, or 70% or greater by weight of the total composition.

The aqueous base may also comprise water-soluble species, such as mineral salts or short chain ($C_{1-4}$) alcohols. The mineral salts may aid the attainment of the desired viscosity for the composition, as may water soluble organic salts and cationic deflocculating polymers, as described in EP 41,698 A2, which is enclosed herein by reference in its entirety. Such salts may be present at from about 0.001 to about 1%, or at from about 0.005 to about 0.1% by weight of the total composition. Examples of suitable mineral salts for this purpose include calcium chloride, magnesium chloride and potassium chloride. Short chain alcohols that may be present include primary alcohols, such as ethanol, propanol, and butanol, secondary alcohols such as isopropanol, and polyhydric alcohols such as propylene glycol and glycerol. The short chain alcohol may be added with cationic softening agent during the preparation of the composition.

The detergency adjuvants or builders can be used to improve the surface properties of the surfactants. Builders can be organic and/or inomanic. The inorganic builders can include, but are not limited to, alkali metal, ammonium or alkanolamine polyphosphates; alkali metal pyrophosphates; zeolites; silicates; alkali metal or alkaline earth metal borates, carbonates, bicarbonates or sesquicarbonates; and cogranules of alkali metal (sodium or potassium) silicate hydrates and of alkali metal (sodium or potassium) carbonates.

The organic builders can include, but are riot limited to, organic phosphates; and polycarboxylic acids and/or their water-soluble salts and water-soluble salts of carboxylic polymers. Examples can include, but are not limited to, polycarboxylate or hydroxypolycarboxylate ethers; polyacetic acids or their salts (nitriloacetic acid, dicarboxymethyl-2-aminopentanedioic acid, ethylenediaminetetraacetic acid, diethylenetriaminepentaacetic acid, ethylenediaminetetraacetates, nitrilotriacetates); ($C_5$-$C_{20}$ alkyl)succinic acid salts; polycarboxylic acetal esters; polyaspartic or polyglutamic acid salts; and citric acid, gluconic acid or tartaric acid or their salts.

The auxiliary cleaning agents can be copolymers of acrylic acid and of maleic anhydride or acrylic acid homopolymers type. The bleaching active agents can be perborates or percarbonates type, which may or may not be combined with acetylated bleaching activators, such as N,N,N',N'-tetraacetylethylenediamine (TAED), or chlorinated products of the chloroisocyanurates type, or chlorinated products of the alkali metal hypochlorites type.

Either hydrophobic or hydrophilic biocidal active agents can also be used. A biocidal agent is considered as being "hydrophobic" when its solubility in water at 25° C. is less than about 1% by weight, preferably less than about 0.1% by weight. As examples of hydrophobic biocidal agents, mention may be made of para-chloro-meta-xylenol or dichloro-meta-xylenol, 4-chloro-m-cresol, resorcinol monoacetate, mono- or poly-alkyl or -aryl phenols, cresols or resorcinols, such as o-phenylphenol, p-tert-butylphenol or 6-n-amyl-m-cresol, alkyl and/or aryl-chloro- or -bromophenols, such as o-benzyl-p-chlorophenol, halogenated diphenyl ethers such as 2',4,4'-trichloro-2-hydroxy-diphenyl ether (triclosan) and 2,2'-dihydroxy-5,5'-dibromo-diphenyl ether, and chlorophenesin (p-chloro-phenylglyceric ether).

As examples of h hydrophilic biocidal active agents, mention may be made of—cationic biocides such as quaternary monoammonium salts such as cocoalkylbenzyldimethylammonium, ($C_{12}$-$C_{14}$)alkylbenzyldimethylammonium, cocoalkyldichlorobenzyldimethylammonium, tetradecylbenzyldimethylammonium, didecyldimethylammonium or dioctyldimethylammonium chlorides, myristyltrimethylammonium or cetyltrimethylammonium bromides monoquaternary heterocyclic amine salts such as laurylpyridinium, cetylpyridinium or ($C_{12}$-$C_{14}$)alkylbenzylimidazolium chlorides, and triphenylphosphonium fatty alkyl salts such as myristyltriphenylphosphonium bromide.

Polymeric biocides can also be used. Examples can include, but are not limited to, those derived from the reactions of epichlorohydrin and of dimethylamine or of diethylamine, of epichlorohydrin and of imidazole, of 1,3-dichloro-2-propanol and of dimethylamine, of 1,3-dichloro-2-propanol and of 1,3-bis(dimethylamino)-2-propanol, of ethylene dichloride and of 1,3-bis(dimethylamino)-2-propanol, and bis(2-chloroethyl) ether and of N,N'-bis (dimethylaminopropyl)-urea or thiourea; biguanidine polymeric hydrochlorides; amphoteric biocides such as derivatives of N-(N'-$C_8$-$C_{18}$alkyl-3-aminopropyl)glycine, of N-(N'-(N"-$C_8$-$C_{18}$alkyl-2-aminoethyl)-2-aminoethyl)glycine, of N,N-bis(N'-$C_8$-$C_{18}$alkyl-2-aminoethyl)glycine, such as (dodecyl)(aminopropyl)glycine and (dodecyl)(diethylenediamine) glycine; amines such as N-(3-aminopropyl)-N-dodecyl-1,3-propanediamine; halogenated biocides, for instance iodophores and hypochlorite salts, such as sodium dichloroisocyanurate; and phenolic biocides such asphenol, resorcinol and cresols.

The liquid home care compositions of the present disclosure may contain one or more other ingredients. Such ingredients include preservatives (e.g. bactericides), pH buffering agents, perfume carriers, fluorescers, colorants, hydrotropes, antifoaming agents, anti-redeposition agents, soil-release agents, polyelectrolytes, enzymes, optical brightening agents, anti-shrinking agents, anti-wrinkle agents, anti-spotting agents, anti-oxidants, sunscreens, anti-corrosion agents, drape imparting agents, anti-static agents, ironing aids and dyes.

The liquid home care composition can be used particularly for cleaning, rinsing, care or treatment of industrial, domestic or communal hard surfaces, as well as textile article surfaces; they are targeted at conferring on the latter benefits such as water repellency, soil release, stain resistance, anti-fogging, surface repair, anti-wrinkling, shine, lubrication and/or at improving the residuality, impact and or efficacy of active materials comprised in the compositions on the surfaces treated therewith. The term "hard surfaces" means surfaces such as glass, windowpanes, ceramic, tiling, walls, floors, dishwares, stainless steel, hard organic polymer, and wood.

The liquid home care composition in the present disclosure can be any compositions and/or formulations used in home care including but not limited to, liquid detergents, dish washers, carpet cleaners, fabric softeners, hard-surface cleaners, bath-room cleaners, and all- purpose cleaners.

In general, the liquid home care composition has a Brookfield viscosity ranged from about 50 to about 10,000 mPa·s and is a clear single phase liquid. In one non-limiting embodiment, the liquid home care composition has a viscosity ranged from about 110 to 7000 mPa·s. In another non-limiting embodiment, the liquid home care composition has a viscosity ranged from about 2000 to 6000 mPa·s. The Brookfield viscosity of the composition in the present disclosure can be measured on a Brookfield viscometer model #LVDVII+ using the spindle #2 or #62 or #63 at 25° and 12 rpm.

The liquid home care composition of the present disclosure can have a pH value of from 3 to 12. In one non-limiting embodiment, the pH value is from 6 to 12. In another non-limiting embodiment, the pH value is from 7 to 9.

The liquid home care composition in the present disclosure is a clear and/or transparent single phase solution. The term "clear" or "transparent", as used herein, has its usual dictionary definition. By the word clear or transparent is meant that the liquid home care composition is capable of transmitting light there through. Clarity or transparency of a solution can be described and quantified by measuring the percent transmittance of light through a. solution at a specific wavelength of light. Typically, a one centimeter of the liquid path length of the present disclosure permits over a 90% or 95%, or 99% transmittance of light at 600 nm wavelength measured at 23° C. The present disclosure is not bound by this range of transmittance, however, relying on the usual dictionary definition of "clear" and the meaning known in the art.

Salts can also be added to the liquid home care composition of the present disclosure. The liquid home care composition of the present disclosure demonstrates excellent compatibility in the presence of the salts. Suitable salts can include, but are not limited to, sodium and potassium salts. In one non-limiting embodiment, sodium chloride is an especially preferred salt and is preferably used in an amount of from 0.1 wt % to 2 wt % based on the total amount of the liquid home care composition.

Other optional ingredients like thickening agents, chelating agents, deodorants, dyes, emollients, moisturizers, enzymes, foam boosters, germicides, anti-microbials, lathering agents, pearlescers, skin conditioners, solvents, stabilizers, superfatting agents, etc. may be added in suitable amounts in the process of the present disclosure, provided the transparency of the liquid home care composition. is retained. Preferably, the ingredients are added after the essential ingredients are mixed in the composition.

The following examples illustrate the present disclosure, parts and percentages being by weight, unless otherwise indicated. Each example is provided by way of explanation of the present disclosure, not limitation of the present disclosure. In fact, it will be apparent to those skilled in the art that various modifications and variations can be made in the present disclosure without departing from the scope or spirit of the invention. For instance, features illustrated or described as part of one embodiment, can be used on another embodiment to yield a still further embodiment. Thus, it is intended that the presently disclosed and claimed inventive concept(s) covers such modifications and variations as come within the scope of the appended claims and their equivalents.

EXAMPLES

Polymer Preparation

Polymer III-A and Polymer III-B1-B9

Polymer III-A and Polymers III B1-B9 were prepared in a 3.75-liter reactor. The reactor was loaded with 120 g of cellulose and a mixture containing 104.4 g of water, 1163.6 g of 97.3% tertiary butyl alcohol, 102.4 g of isopropyl alcohol and 14.1 g of acetone. A thorough nitrogen purge was conducted to remove oxygen. After the purging the reactor was pressurized to 4 bars with nitrogen and the stirrer was started at 1400 RPM. 84.6 g of 40% NaOH solution was gradually added. After the addition, the cellulose was swollen for 45 minutes to form alkali cellulose. The reactor was again purged with nitrogen to remove oxygen generated from the swollen cellulose fibers.

43.9 g of ethylene oxide (EO) (the first part) was added into the reactor. The temperature was raised to 85° C. in 45 minutes and remained for another 50 minutes. The reactor was then cooled down to 25° C. and the slurry in the reactor was neutralized down to a caustic/cellulose ratio of 0.079 by adding 59 g of 65% $HNO_3$. After the temperature was lowered down to 25° C., the second part of EO (the amounts are listed in Table 1) was added to the reactor and temperature was raised to 124° C. in 60 minutes. Once the temperature was reached at 124° C. a mixture of n-butyl glydicyl ether (nBGE) and cetyl bromide (C16) was added. The temperature was maintained at 124° C. for 120 minutes and then cooled down to 25° C. in 30 minutes. The reactor was remained at that condition for the next day. 40% NaOH was then added followed by addition of 3-chloro-2-hydroxypropyltrimethylammonium chloride (Quab®188, commercial available from SKW QUAB Chemicals, Inc.) and a purge cycle. After addition of NaOH and Quab®188 the reactor temperature was raised to 55° C. in 20 minutes and remained for another 60 minutes. The reactor was then cooled and neutralized using 29.1 g of 65% $HNO_3$ and 2.1 g of 10% acetic acid. The product was purified in aqueous acetone solution. The slurry was then filtered and the wet cake was dried in a ventilated stove at 60° C. for 60 minutes.

TABLE 1

Ingredients for Preparing Polymer III-A and Polymers III-B1 to III-B9

| Polymer | EO ($2^{nd}$ part), g | nBGE, g | C16, g | 40% NaOH, g | Quat ® 188, g |
|---|---|---|---|---|---|
| Polymer III-A | 137.4 | 21.0 | 15.4 | 19.5 | 36.0 |
| Polymer III-B1 | 113.5 | 12.4 | 12.0 | 19.5 | 36.0 |
| Polymer III-B2 | 113.5 | 12.4 | 12.0 | 19.5 | 36.0 |
| Polymer III-B3 | 113.5 | 12.4 | 12.0 | 26.1 | 53.9 |
| Polymer III-B4 | 113.5 | 12.4 | 12.0 | 19.5 | 36.0 |
| Polymer III-B5 | 113.5 | 0.8 | 9.0 | 19.5 | 36.0 |
| Polymer III-B6 | 113.5 | 24.9 | 21.7 | 19.5 | 36.0 |
| Polymer III-B7 | 113.5 | 12.4 | 12.0 | 14.2 | 21.5 |
| Polymer III-B8* | 137.4 | 12.4 | 15.4 | 19.5 | 36.0 |
| Polymer III-B9* | 137.4 | 21.0 | 15.4 | 19.5 | 36.0 |

*The polymers were made from the cellulose with IV = 20.5. Other polymers in the table were made from the cellulose with IV = 15.

Polymer III-B10

Polymer III-B10 was prepared in a 10-gallon reactor. The reactor was loaded with 2.6 kg of cellulose (IV=15) and a mixture containing 1344 g of water, 16 kg of 97.3% tertiary butyl alcohol, 988 g of isopropyl alcohol and 159 g of acetone. A thorough nitrogen purge was conducted to remove oxygen from the reactor. After the purging the reactor was pressurized to 4 bars with nitrogen and the stirrer was started at 1400 RPM. 717 g of 40% NaOH solution was gradually added and after this addition the cellulose was swollen for 45 minutes to form alkali cellulose. The reactor was again purged with nitrogen to remove oxygen generated from the swollen cellulose fibers.

904 g of ethylene oxide (EO) (the first part)was added into the reactor and temperature was raised to 85° C. in 45 minutes where it remained for another 50 minutes. The reactor was cooled down to 25° C. and the slurry in the reactor was neutralized down to a caustic/cellulose ratio of 0.079 by adding 1133.1 g of 65% $HNO_3$. After the temperature was lowered down again to 25° C., 2435 g of EO (the second part) was added to the reactor and temperature was raised to 124° C. in 60 minutes. Once the temperature was reached at 124° C. a mixture of 254 g of nBGE and 247 g of C16 was added. The temperature was maintained at 124° C. for 120 minutes and then cooled down to 25° C. in 30 minutes. The reactor remained at that condition for the next day. 401.3 g of 40% NaOH was then added followed by 741.4 g of addition of Quab®188 and a purge cycle. After addition of NaOH and Quab®188 the reactor temperature was raised to 55° C. in 20 minutes and remained for another 60 minutes. The reactor was then cooled and neutralized using 560 g of 65% $HNO_3$. The product was purified in aqueous acetone solution. The slurry was filtered then and the wet cake was dried at 60° C. for 60 minutes.

Polymer Characterization

Polymers were characterized by NMR measurements. Samples of the polymers were acid hydrolyzed prior to the NMR measurements.

Sample Hydrolysis: 25 mg of sample was initially swelled in 0.4 gm of $D_2O$ and 0.4 gm of DMSO-$d_6$ in a vial. To the swelled solution, 1.5 gm of 3M trifluoroacetic acid (TFA) was added. The sample solution vial was maintained at 100° C. for 5 hours. The solution vial was cooled for 15 minutes before 0.3 gm of $D_2SO_4$ was added. The sample solution was maintained at 100° C. for one additional hour. The sample solution was allowed to cool down (~30 mins) and 1 gm of the sample solution was transferred to 5 mm NMR tube for analysis.

NMR Measurement: Quantitative $^1H$ NMR spectrum was recorded using Bruker 400 MHz NMR spectrometer. Acquisition parameters were as follows: temperature 300K, sweep width 20 ppm, pulse width 45 deg, number of scans 128, relaxation delay 30 s. Processing parameters were as follows: line broadening 0.3 Hz.

Spectrum was phase and baseline corrected using standard practice. Down-field peak of unsubstituted β-glucose doublet peak was referenced to 5.2425 ppm in anomeric region (4.44-5.60 ppm).

Region A ($I_A$)=4.44-5.60 ppm (integral area was calibrated to a value of 1.0, other integral areas were relative to this integral value);

Region B ($I_B$)=2.92-4.44 ppm;

Region C ($I_C$)=3.67-3.68 ppm;

Region D ($I_D$)=3.28-3.33 ppm (only for Quat containing derivative);

Region E ($I_E$)=3.21-3.25 ppm (only for Quat containing derivative);

Region F ($I_F$)=1.31-1.39 ppm (only for C4 containing derivative);

Region G (IG)=1.12-1.44 ppm (only for C16 containing derivative).

DS/MS were calculated as follows:

$$HE\ MS=(I_B-I_C-(I_E*1.55)-(I_D*1.22)-(I_F*7)-((I_G-(I_F*2))/13)-(I_A*6))/(4*I_A);$$

$$C4\ DS=(I_F)/(I_A);$$

$C16\ DS=((I_G-(I_F*2))/26)/(I_A)$; and $\text{Quat}\ DS=(I_E/9)/(I_A)$.

C4 and C16 DS are listed in Table 2 as wt %, which can be calculated based on the formulas described below:

$$C4\ \text{wt}\ \%=(C4\ DS*147.2*100)/(162.14+(HE\ MS*44.05)+(C4\ DS*131.2)+(C16\ DS*225.4)+(\text{Quat}\ DS*151.6));$$

$$C16\ \text{wt}\ \%=(C16\ DS*241.4*100)/(162.14+(HE\ MS*44.05)+(C4\ DS*131.2)+(C16\ DS*225.4)+(\text{Quat}\ DS*151.6)).$$

Table 2 lists the characterizations of the polymers used in liquid home care compositions.

TABLE 2

Characterization of the Polymers

| Polymer Sample | HE-MS | Hydrophobe Moiety, wt % C4 | Hydrophobe Moiety, wt % C16 | Cationic Content, D.S. |
|---|---|---|---|---|
| Polymer I* | 2.50 | 0 | 0 | 0 |
| Polymer II** | 3.30 | 0 | 1 | 0 |
| Polymer III-A | 4.60 | 5.58 | 1.48 | 0 |
| Polymer III-B1 | 3.95 | 3.59 | 1.19 | 0.09 |
| Polymer III-B2 | 3.72 | 3.55 | 1.29 | 0.093 |
| Polymer III-B3 | 4.68 | 2.70 | 1.11 | 0.136 |
| Polymer III-B4 | 4.04 | 3.75 | 1.48 | 0.110 |
| Polymer III-B5 | 3.98 | 2.44 | 0.84 | 0.096 |
| Polymer III-B6 | 3.78 | 6.90 | 2.01 | 0.100 |
| Polymer III-B7 | 4.00 | 3.47 | 1.05 | 0.063 |
| Polymer III-B8 | 3.95 | 2.97 | 1.17 | 0.087 |
| Polymer III-B9 | 3.90 | 4.92 | 1.49 | 0.087 |
| Polymer III-B10 | 3.47 | 3.29 | 1.07 | 0.095 |

*Natrosol™ 250 HHRP 5565-Hydroxyethyl cellulose, commercially available from Hercules LLC.
**Natrosol™ Plus 330-Hydrophobically modified hydroxyethyl cellulose, commercially available from Hercules LLC.

Application of Polymers in Home Care

The polymers were used in home care systems containing various contents of the surfactants. Tables 3-5 list the systems containing low, medium and high contents of the surfactants before adding the polymers, respectively.

TABLE 3

Low Surfactant System

| Ingredient | Wt %, Active Simple | Wt %, Active Complex | Wt % As Is Simple | Wt % As Is Complex |
|---|---|---|---|---|
| Deionized water | | | 86.9 | 85.23 |
| LAS (95%) | 1 | 1 | 1.05 | 1.05 |
| Lutensol AO 7 | 2 | 2 | 2 | 2 |
| SLES (28.3%) | 2 | 2 | 7.07 | 7.07 |
| Propylene glycol | 2 | 2 | 2 | 2 |
| NaOH (30%) | 0.135 | 0.135 | 0.45 | 0.45 |
| Surfadone LP100 | 0 | 0.2 | 0 | 0.2 |
| Sorez 100 (75.5%) | 0 | 1.51 | 0 | 2 |
| pH | | | 7.3 | 7.1 |
| Total Surfactant, % | | | 5 | 5 |

LAS-dodecylbenzene sulfonic acid
Lutensol AO 7-C10-C16 ethoxylated alcohol 7EO
SLES-Sodium lauryl ether sulfate
Surfadone LP100-N-octyl-2-pyrrolidone
Sorez 100-Polyethylene glycol polyether copolymer

TABLE 4

Medium Surfactant System

| Compound | Wt %, Active Simple | Wt %, Active Complex | Wt % As Is Simple | Wt % As Is Complex |
|---|---|---|---|---|
| Deionized water | | | 46.55 | 44.85 |
| CAPB (30.5%) | 2 | 2 | 6.55 | 6.55 |
| Lutensol AO7 | 2 | 2 | 2 | 2 |
| SLES (28.3%) | 12 | 12 | 42.4 | 42.4 |
| Propylene glycol | 2 | 2 | 2 | 2 |
| Surfadone LP100 | 0 | 0.2 | 0 | 0.2 |
| Sorez 100 (75.5%) | 0 | 1.51 | 0 | 2 |
| pH | | | 8.0 | 8.0 |
| Total Surfactant, % | | | 16 | 16 |

CAPB-Cocamidpropyl betaine

TABLE 5

High Surfactant System

| Compound | Wt %, Active Simple | Wt %, Active Complex | Compound, wt % Simple | Compound, wt % Complex |
|---|---|---|---|---|
| Deionized water | | | 23.92 | 17.72 |
| LAS (95%) | 13 | 13 | 13.68 | 13.68 |
| Lutensol AO7 | 7 | 7 | 7 | 7 |
| SLES (28.3%) | 12 | 12 | 42.4 | 42.4 |
| Propylene glycol | 7 | 7 | 7 | 7 |
| Surfadone LP100 | 0 | 0.2 | 0 | 0.2 |
| Sorez 100 (75.5%) | 0 | 1.51 | 0 | 2 |
| Polyimine 1800-2000 (50%) | 0 | 2 | 0 | 4 |
| NaOH (30%) | 1.8 | 1.8 | 6 | 6 |
| pH | | | 10.6 | 10.7 |
| Total Surfactant, % | | | 32 | 32 |

0.5 wt % of the Polymers I, II, III-A and III-B1 were added into the home care composition at various surfactant contents corresponding to Tables 3-5, respectively. The testing results are shown in Tables 6-8. The Brookfield viscosity was measured at 12 rpm and 25° C. using spindle #2.

TABLE 6

Polymers in Low Surfactant System

| Polymer 0.5 w/w % | Simple Appearance | Simple Brookfield Viscosity (12/2) mPa · s | Complex Appearance | Complex Brookfield Viscosity (12/2) mPa · s |
|---|---|---|---|---|
| No Polymer | Clear | <10 | Clear | <10 |
| Polymer I | Two layers | 395 | Two layers | — |
| Polymer II | Clear | 10 | Clear | 15 |
| Polymer III-A | Clear | 63 | Clear | 48 |
| Polymer III-B-1 | Clear | 118 | Clear | 113 |

TABLE 7

| Polymers in Medium Surfactant System | | | | |
|---|---|---|---|---|
| | Simple | | Complex | |
| Polymer 0.5 w/w % | Appearance | Brookfield Viscosity (12/2) mPa · s | Appearance | Brookfield Viscosity (12/2) mPa · s |
| No Polymer | Clear | <10 | Clear | <10 |
| Polymer I | Two layers | — | Two layers | — |
| Polymer II | Clear | 3 | Clear | 75 |
| Polymer III-A | Clear | 110 | Clear | 195 |
| Polymer III-B1 | Clear | 200 | Clear | 340 |

TABLE 8

| Polymers in High Surfactant System | | | | |
|---|---|---|---|---|
| | Simple | | Complex | |
| Polymer 0.5 w/w % | Appearance | Brookfield Viscosity (12/2) mPa · s | Appearance | Brookfield Viscosity (12/2) mPa · s |
| No Polymer | Clear | 682 | Clear | 210 |
| Polymer I | Two layers | — | Two layers | — |
| Polymer II | Two layers | 1965 | Two layers | 220 |
| Polymer III-B1 | Clear | 7950 | Clear | 2300 |

Table 9 shows the Brookfield viscosity efficiencies of the polymers.

TABLE 9

| Brookfield Viscosities of the Polymers in Various Surfactant Systems | | | | |
|---|---|---|---|---|
| Polymer (0.5 w/w%) | | Polymer I | Polymer II | Polymer III-B1 |
| Low Surfactant | Control | | <10 mPa · s | |
| | Simple | Incompatible | Low (10 mPa · s) | High (118 mPa · s) |
| | Complex | Incompatible | Low (13 mPa · s) | High (113 mPa · s) |
| Medium Surfactant | Control | | 10 mPa · s | |
| | Simple | Incompatible | Low (10 mPa · s) | High (200 mPa · s) |
| | Complex | Incompatible | Medium (75 mPa · s) | High (340 mPa · s) |
| High Surfactant | Control | | 682 mPa · s (Simple)<br>210 mPa · s (Complex) | |
| | Simple | Incompatible | Incompatible | Very high (7950 mPa · s) |
| | Complex | Incompatible | Incompatible | Very high (2300 mPa · s) |

Polymers III B2-B10 were added into the home care composition having the complex systems with various surfactant contents, and the complex system with 1 wt % of NaCl and various surfactant contents. The appearances of the resulted home care compositions are shown in Table 10. "Clear" in Table 10 means the solution was visually clear and thick. "Clear*" in Table 10 means the solution was visually clear with visible fibers.

TABLE 10

| Appearance of Home Care Compositions | | | | | | |
|---|---|---|---|---|---|---|
| Polymer | Low Surfactant | | Medium Surfactant | | High Surfactant | |
| (0.5 w/w %) | — | 1 wt % NaCl | — | 1 wt % NaCl | — | 1 wt % NaCl |
| Polymer III-B2 | Clear | Clear | Clear | Clear | Clear | Clear |
| Polymer III-B3 | Layer | Clear | Clear | Clear | Clear | Clear |
| Polymer III-B4 | Clear | Clear* | Clear | Clear | Clear | Clear |
| Polymer III-B5 | Clear | Clear | Clear | Clear | Clear | Clear |
| Polymer III-B6 | Clear* | Clear | Clear | Clear | Clear | Clear |
| Polymer III-B7 | Clear | Clear | Clear | Clear | Clear | Clear |
| Polymer III-B8 | Clear | Clear | Clear | Clear | Clear | Clear |
| Polymer III-B9 | Clear | Clear | Hazy | Clear | Clear | Clear |
| Polymer III-B10 | Clear | Clear | Clear | Clear | Clear | Clear |

What is claimed is:

1. A liquid home care composition comprising:

(a) a mixed hydrophobically modified cationic polysaccharide comprising a polysaccharide backbone having at least one cationic group, and 1 to 10 wt % of $C_3$-$C_8$ short chain hydrophobic group and 0.1 to 2 wt % of $C_9$-$C_{24}$ long chain hydrophobic group attached thereon;

(b) at least one surfactant; and (c) at least one additive agent selected from detergent adjuvants or builders, auxiliary cleaning agents, acidic cleaning agents, metal chelating agents, calcium-sequesting agents, hydrotropic agents, bleaching agents, abrasives, biocidal or antimictobial agents, corrosion inhibitors, enzymes, anti-redeposition agents, anti-color transfer agents, and soil-release agents, wherein the liquid home care composition is a clear single phase liquid and the polysaccharide backbone is water soluble or water insoluble.

2. The liquid home care composition of claim 1, wherein the polysaccharide backbone is cellulose ether.

3. The liquid home care composition of claim 2, wherein the cellulose ether is selected from the group consisting of hydroxyethyl cellulose (HEC), hydroxypropyl cellulose (HPC), methyl cellulose (MC), hydroxypropylmethyl cellulose (HPMC), ethylhydroxyethyl cellulose (EHEC), and methylhydroxyethyl cellulose (MHEC).

4. The liquid home care composition of claim 1, wherein the water insoluble polysaccharide backbone is soluble in a solution containing a surfactant.

5. The liquid home care composition of claim 1, wherein the $C_3$-$C_8$ short chain hydrophobic group is a $C_4$ hydrophobic group.

6. The liquid home care composition of claim 1, wherein the $C_9$-$C_{24}$ long chain hydrophobic group is a $C_{16}$ hydrophobic group.

7. The liquid home care composition of claim 1, wherein the at least one surfactant is selected from the group consisting of an anionic surfactant, a nonionic surfactant, an amphoteric surfactant, a zwitterionic surfactant, and combinations thereof.

8. The liquid home care composition of claim 1, wherein the mixed hydrophobically modified cationic polysaccharide has a weight average molecular weight of 50,000 to 1,500,000 Daltons.

9. The liquid home care composition of claim 1, wherein the mixed hydrophobically modified cationic polysaccharide has a cationic degree of substituent (DS) of 0.01 to 0.3.

10. The liquid home care composition of claim 1, wherein the composition comprises 0.01 to 2 wt % of the mixed hydrophobically modified cationic polysaccharide based on the total amount of the home care composition.

11. The liquid home care composition of claim 1, wherein the pH of the home care composition is from 3 to 12.

12. The liquid home care composition of claim 1, wherein the amount of the at least one surfactant is ranged from 0.3 wt % to 80 wt % based on the total amount of the home care composition.

13. The liquid home care composition of claim 1, having a Brookfield viscosity of 50-10,000 mPa·s.

14. The liquid home care composition of claim 7, wherein the anionic surfactant is selected from the group consisting of a linear alkyl sulfonate (LAS), a linear alkyl aryl sulfonate, and an alcohol ether sulfate.

15. The liquid home composition of claim 7, wherein the nonionic surfactant is selected from the group consisting of $C_8$-$C_{22}$ aliphatic alcohols with 1 to 25 moles of ethylene oxide, alkylpolyglycosides, fatty acid amides, and mixtures thereof.

16. The liquid home care composition of claim 1, further comprising propylene glycol.

17. The liquid home care composition of claim 1, further comprising an N-alkyl pyrrolidone.

18. The liquid home care composition of claim 17, further comprising an alkyloxylated polyethyleneimine polymer having a weight average molecular weight from 400 to 10,000 Daltons.

19. The liquid home care composition of claim 1, wherein the liquid home care composition is a liquid laundry detergent composition, a dish washer composition, a fabric softening composition, a hard surface cleaning composition, a bath-room cleaning composition, or an all-purpose cleaning composition.

* * * * *